US009392659B2

(12) United States Patent
Ishizuka et al.

(10) Patent No.: US 9,392,659 B2
(45) Date of Patent: Jul. 12, 2016

(54) LIGHT-EMITTING DEVICE

(71) Applicant: Pioneer Corporation, Kawasaki-shi, Kanagawa (JP)

(72) Inventors: Shinichi Ishizuka, Kawasaki (JP); Takeshi Nakamura, Kawasaki (JP)

(73) Assignee: PIONEER CORPORATION, Kawasaki-Shi, Kanagawa (JP)

( * ) Notice: Subject to any disclaimer, the term of this patent is extended or adjusted under 35 U.S.C. 154(b) by 0 days.

(21) Appl. No.: 14/650,162

(22) PCT Filed: Dec. 10, 2012

(86) PCT No.: PCT/JP2012/081905

§ 371 (c)(1),
(2) Date: Jun. 5, 2015

(87) PCT Pub. No.: WO2014/091533

PCT Pub. Date: Jun. 19, 2014

(65) Prior Publication Data

US 2015/0327344 A1 Nov. 12, 2015

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |
| ***H05B 37/02*** | (2006.01) |

(52) U.S. Cl.
CPC ..... *H05B 33/0845* (2013.01); *H05B 37/0254* (2013.01)

(58) Field of Classification Search
None
See application file for complete search history.

(56) References Cited

U.S. PATENT DOCUMENTS

| | | | | |
|---|---|---|---|---|
| 2004/0160199 | A1 | 8/2004 | Morgan et al. | |
| 2008/0231203 | A1 | 9/2008 | Budde et al. | |
| 2010/0253531 | A1 * | 10/2010 | Qiu et al. | 340/691.3 |
| 2011/0035404 | A1 | 2/2011 | Morgan et al. | |

FOREIGN PATENT DOCUMENTS

| | | | |
|---|---|---|---|
| JP | H10-40206 | A | 2/1998 |
| JP | 3648582 | B | 7/1998 |
| JP | 2005-517278 | A | 6/2005 |
| JP | 2007-123045 | A | 5/2007 |
| JP | 2008-109514 | A | 5/2008 |
| JP | 2009-503778 | A | 1/2009 |
| JP | 2010-103023 | A | 5/2010 |
| JP | 2011-018466 | A | 1/2011 |
| JP | 2011-508401 | A | 3/2011 |

OTHER PUBLICATIONS

International Search Report for PCT/JP2012/081905, dated Mar. 19, 2013.

* cited by examiner

*Primary Examiner* — Anh Tran
(74) *Attorney, Agent, or Firm* — Procopio, Cory, Hargreaves, Savitch & LLP

(57) ABSTRACT

A light-emitting control unit (24) controls a light source (26). Specifically, the light-emitting control unit (24) controls the light source (26) in accordance with control data which is transmitted from a master control unit (10) through a communication line (32). A communication control unit (22) controls connection between the light-emitting control unit (24) and the communication line (32). Further, the communication control units (22) of a plurality of light-emitting modules (20) are connected to each other in series through a control line (34). In addition, the communication control unit (22) located at an uppermost stream is connected to the master control unit (10) through the control line (34).

6 Claims, 7 Drawing Sheets

(a)

(b)

(c)

LIGHT-EMITTING DEVICE

TECHNICAL FIELD

The present invention relates to a light-emitting device.

BACKGROUND ART

A plurality of panel-shaped light-emitting sources such as an organic EL (organic electroluminescence) panel or a light-emitting diode (LED) panel disposed side by side may be used as one light-emitting device. In such a light-emitting device, it is possible to perform illumination in various forms by controlling a plurality of light-emitting sources.

On the other hand, a DMX512-A standard is used as a standard for controlling a light-emitting device. In the DMX512-A standard, a light-emitting device is constituted of a master control unit for controlling a plurality of light-emitting sources and a slave device which includes a light-emitting source and a control unit. The master control unit transmits a command including control data to the slave device through a communication line. The control unit included in the slave device controls the light-emitting source in accordance with the control data included in the command.

Meanwhile, Patent Document 1 discloses the following technique regarding an illumination apparatus for guidance. The control device includes a main control board and a plurality of control units. The plurality of control units are connected to the main control board in series. A plurality of illumination devices are connected in series to each of the plurality of control units.

RELATED DOCUMENT

Patent Document

[Patent Document 1] Japanese Patent No. 3648582

SUMMARY OF THE INVENTION

When a light-emitting device is controlled using a DMX512-A standard, it is necessary to set an address in each of a plurality of light-emitting modules. In a light-emitting device of the related art, it is necessary to set an address in each light-emitting module using a Dip switch or a rotary switch. In this case, an effort is required to set the address.

An example of an object of the invention is to reduce the effort when assigning an address to each light-emitting module in a light-emitting device including a plurality of light-emitting modules.

According to an aspect of the invention, there is provided a light-emitting device including a plurality of light-emitting modules; a master control unit that generates control data for the plurality of light-emitting modules; and a communication line through which the control data is output from the master control unit and to which the plurality of light-emitting modules are connected in parallel. Each of the plurality of light-emitting modules includes a light-emitting source, a light-emitting control unit that controls the light-emitting source, and a communication control unit that controls connection between the light-emitting control unit and the communication line. The plurality of communication control units are connected to each other in series through a control line, and the communication control unit located at an uppermost stream is connected to the master control unit.

BRIEF DESCRIPTION OF THE DRAWINGS

The above-described objects, other objects, features and advantages will be further apparent from the preferred embodiments described below, and the accompanying drawings as follows.

DESCRIPTION OF EMBODIMENTS

Figure 1:
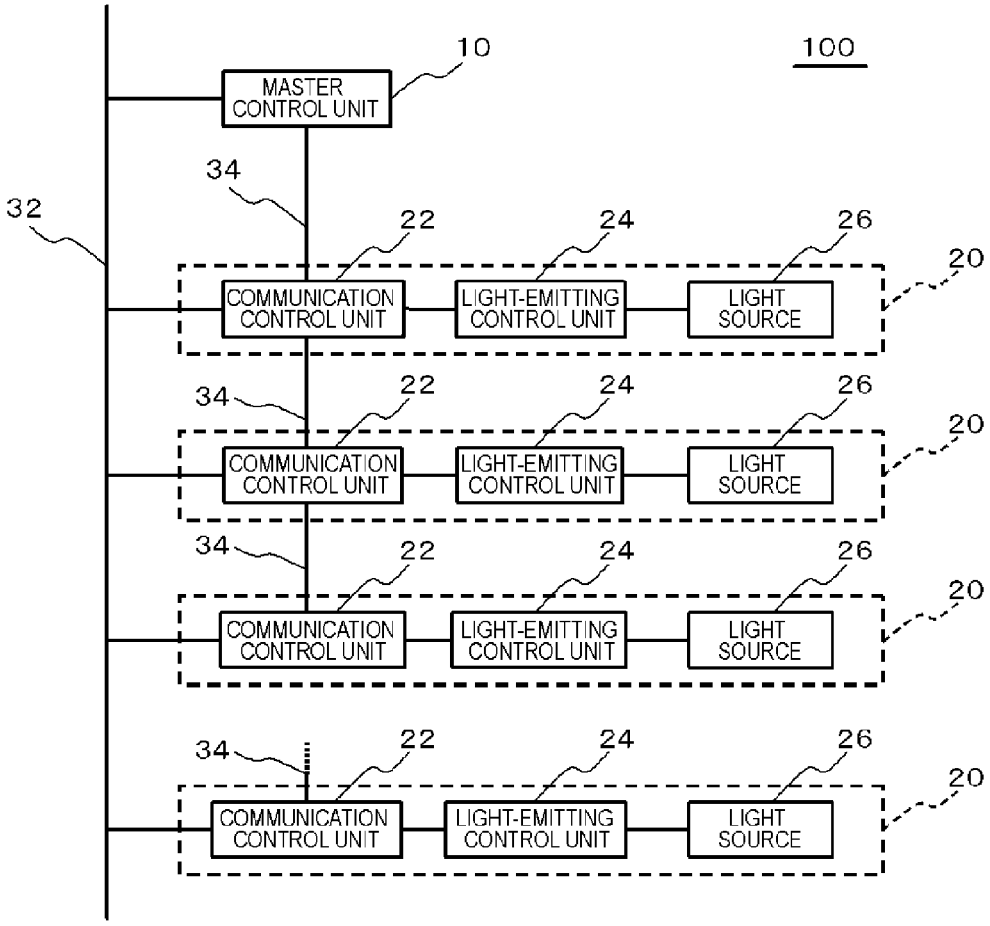
FIG. 1 is a block diagram illustrating a functional configuration of a light-emitting device according to an embodiment.

Hereinafter, embodiments of the invention will be described with reference to the accompanying drawings. In all the drawings, like reference numerals denote like components, and a description thereof will not be repeated.

Meanwhile, in the following description, each component of each control unit indicates a function-based block instead of a hardware-based configuration. Each component of each control unit is realized by a CPU of an arbitrary computer, a memory, a program for embodying the components of the drawing which are loaded in the memory, or a storage medium such as a hard disk that stores the program. The embodying method and apparatus thereof can be modified in various ways.

Embodiment

FIG. 1 is a block diagram illustrating a functional configuration of a light-emitting device 100 according to an embodiment. The light-emitting device 100 according to the present embodiment includes a master control unit 10, light-emitting modules 20, and a communication line 32. The master control unit 10 generates control data for the plurality of light-emitting modules 20. The control data is output to the communication line 32, and each of the plurality of light-emitting modules 20 is connected to the communication line in parallel with each other.

Each of the plurality of light-emitting module S20 includes a communication control unit 22, a light-emitting control unit 24, and a light source 26.

The light source 26 is, for example, an organic EL or an LED. Here, the light source 26 may be another light source. In addition, the light source 26 is, for example, a panel-shaped light source, but may not have a panel shape.

The light-emitting control unit 24 controls the light source 26. Specifically, the light-emitting control unit 24 controls the light source 26 in accordance with the control data which is transmitted from the master control unit 10 through the communication line 32.

The communication control unit 22 controls connection between the light-emitting control unit 24 and the communication line 32. Further, the communication control units 22 of the respective light-emitting modules 20 are connected to each other in series through a control line 34. In addition, the communication control unit 22 positioned at the uppermost stream is connected to the master control unit 10 through the control line 34.

According to the light-emitting device 100 of the embodiment, it is possible to transmit a control signal (hereinafter, referred to as a connection signal), for controlling the connection to the communication line 32, to each communication control unit 22 through the control line 34. The communication control unit 22 can control the connection to the communication line 32 based on the connection signal. Accordingly, when, while the master control unit 10 outputs an address of a certain light-emitting module 20 to the communication line 32, the communication control unit 22 of the certain light-emitting module 20 connects to the communication line 32, it is possible to set the address of that light-emitting module 20. Therefore, it is possible to easily set the addresses of each of the light-emitting modules 20.

In addition, since a plurality of the master control units 10 are not required, it is possible to lower the manufacturing cost of the light-emitting device 100. In addition, since the communication control unit 22 does not require a computation function, it is possible to lower the cost of the communication control unit 22.

EXAMPLES

Example 1

Figure 2:
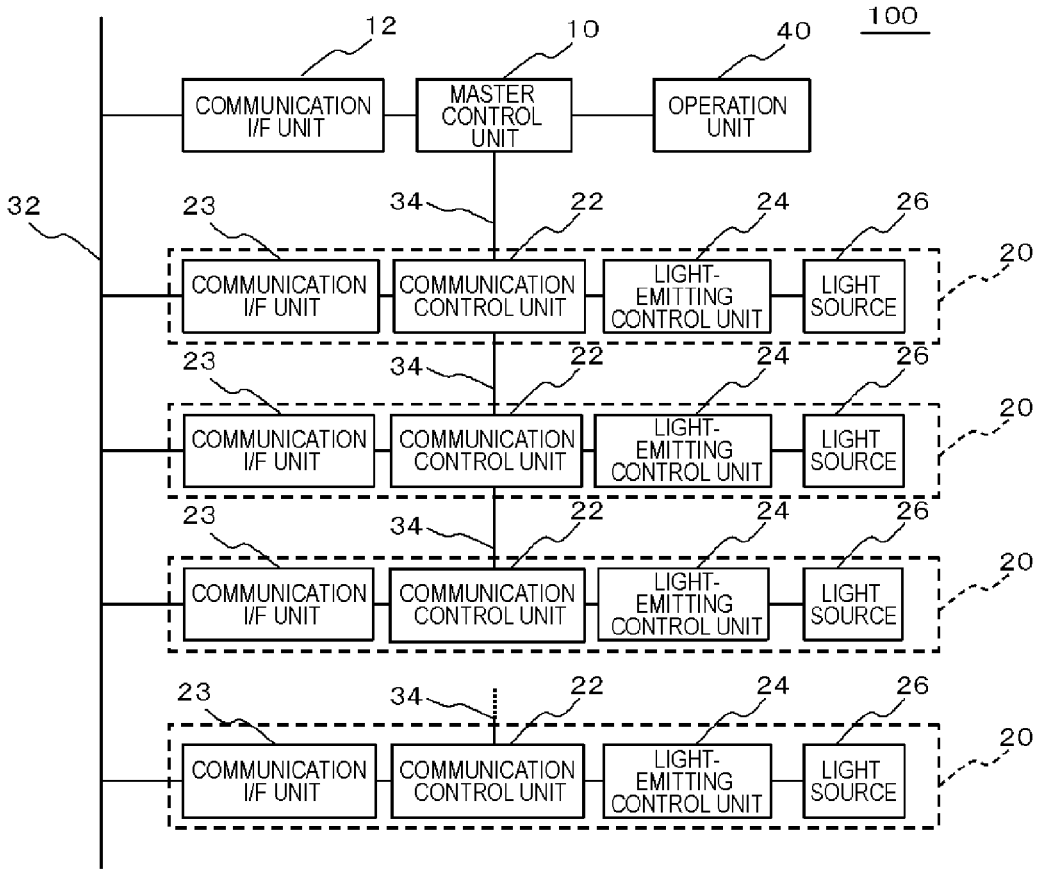
FIG. 2 is a block diagram illustrating the configuration of the light-emitting device according to Example 1.

FIG. 2 is a block diagram illustrating the configuration of a light-emitting device 100 according to Example 1. The light-emitting device 100 according to the present example is a device obtained by adding a communication I/F unit 12, a communication I/F unit 23, and an operation unit 40 to the light-emitting device 100 described in the above-mentioned embodiment.

An operation unit 40 receives an input to the master control unit 10. Specifically, the operation unit 40, which is an input interface, is operated by a user of the light-emitting device 100. The master control unit 10 generates and outputs control data in accordance with an input from the operation unit 40. The communication interface (I/F) unit 12 serves as an interface for connecting the master control unit 10 to the communication line 32.

The communication I/F unit 23 serves as an interface for connecting a communication control unit 22 to a communication line 32.

In addition, the communication control unit 22 includes a reception terminal that receives a connection signal, and an output terminal that outputs the connection signal. Specifically, the reception terminal is a terminal for receiving a connection signal from the communication control unit 22 (or the master control unit 10) which is located one unit before its communication control unit 22. In addition, the output terminal is a terminal for outputting the connection signal to the communication control unit 22 which is located one unit after its communication control unit 22. When the communication control unit 22 receives a connection signal, the communication control unit receives a signal flowing through the communication line 32 through the communication I/F unit 23.

As described in the embodiment, an address of a light-emitting module 20 is set in the communication control unit 22 of the light-emitting module 20. In addition, in the present example, the light-emitting device 100 is based on a DMX512-A standard.

Figure 3:
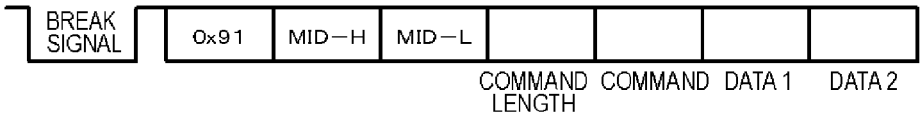
FIG. 3 are diagrams illustrating the structure of control data which is output to a communication line by a master control unit.
Figure 3:
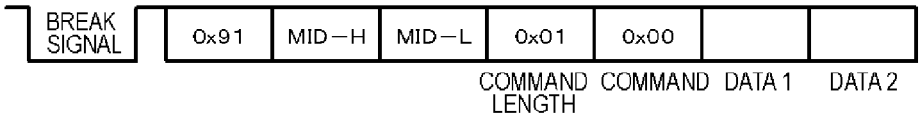
Figure 3:
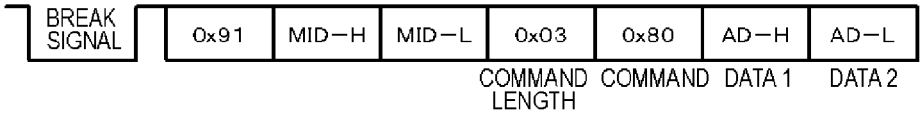

FIG. 3 are diagrams illustrating the structure of control data which is output to the communication line 32 by the master control unit 10. In the DMX512-A standard, an EIA-485 standard (RS-485 standard) is adopted for electricity use of a communication line. For this reason, communication between the master control unit 10 and the light-emitting module 20 is asynchronous serial communication. In addition, a format of the signal thereof is constituted by a one-byte start code and a 512-byte data portion subsequent thereto after a start signal called a break signal.

As the start code, a null command is used when a variety of controls such as illumination control are performed. On the other hand, when a unique command is used, "0x91" is used as the start code. In this case, as illustrated in FIG. 3(*a*), MID (MID-H and MID-L) for identifying a company or an organization which is called a Maucfacture ID is used for 2 bytes after the start code. In addition, a unique command is transmitted using the remaining 510 bytes.

In the present example, when the setting of an address is performed on the light-emitting module 20, "0x91" is used as a start code. In addition, data for setting an address is transmitted using the remaining 510 bytes excluding 2 bytes for MID.

Specifically, as illustrated in FIGS. 3(*b*) and 3(*c*), data indicating a command length (data length) is set in the fourth byte from the beginning, and a command indicating an attribute of data (for example, data indicating that data in the sixth byte or the subsequent byte is an address) is set in the fifth byte from the beginning. For example, when the setting of an address is started, "0x00" is used as the fifth byte. When an address is actually transmitted, "0x80" is used as the fifth byte.

In addition, as illustrated in FIG. 3(*c*), an address is transmitted in the sixth byte or the subsequent byte. In the example illustrated in the drawing, an address is indicated by data in the sixth byte and data in the seventh byte (that is, 2 bytes).

Figure 4:
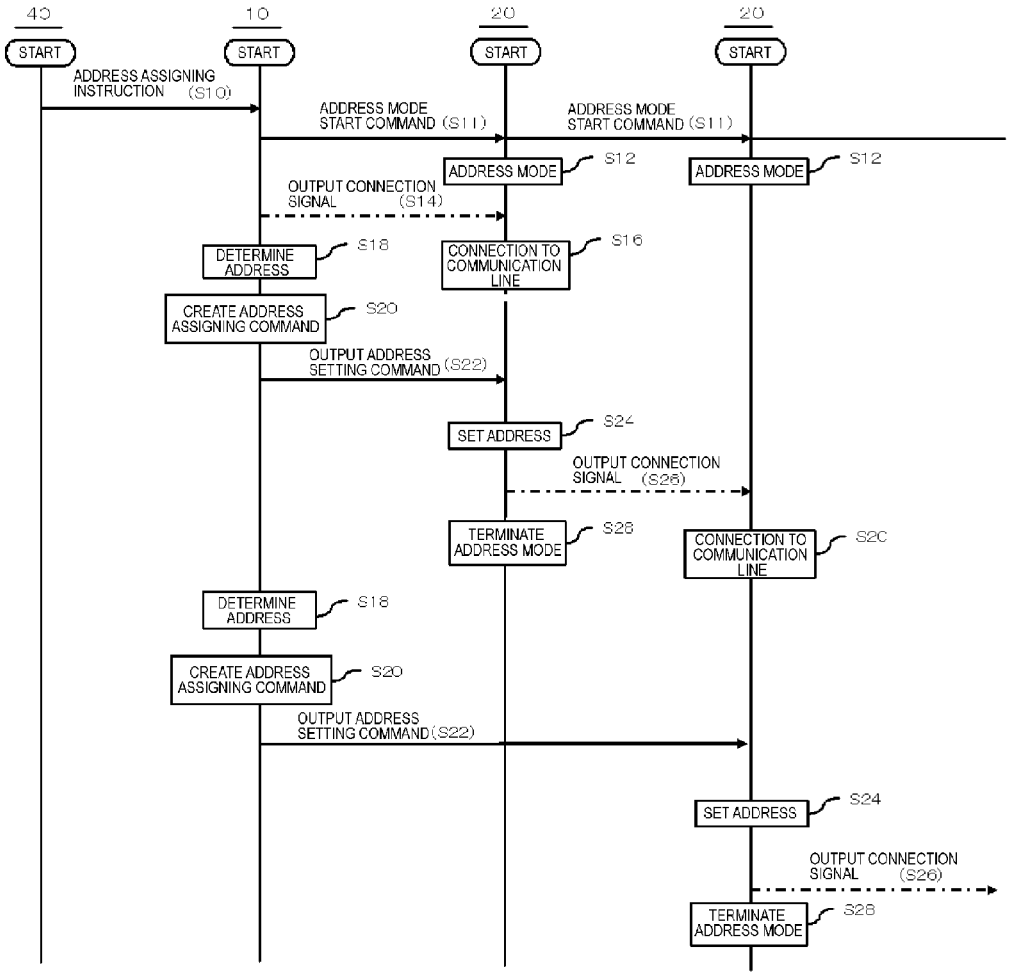
FIG. 4 is a flow chart illustrating processing when an address of a light-emitting module is set.

Next, an operation of assigning an address will be described with reference to a sequence diagram of FIG. 4. In FIG. 4, a signal transmitted through the communication line 32 is shown by a solid line, and a signal transmitted through the control line 34 is shown by a dashed line.

In starting an operation of assigning an address, first, the whole illumination system is set to be in an address mode. For example, when a user performs an input operation for setting an address mode on the operation unit 40, the operation unit 40 generates an address assigning instruction and outputs the generated instruction to the master control unit 10 (step S10). When the master control unit 10 receives an address assigning instruction, the master control unit creates a command (address mode start command) for starting the address mode. The master control unit 10 transmits the created address mode start command to each of the plurality of light-emitting modules 20 through the communication I/F unit 12 and the communication line 32 (step S11). In each of the light-emitting modules 20, when the communication I/F unit 23 receives the address mode start command transmitted from the communication I/F unit 12, the communication control unit 22 of each of the light-emitting modules 20 resets address information. In addition, each communication control unit 22 is set to be in a state where the communication control unit does not accept an address assigning command that flows through the communication line 32 (address mode: step S12) as long as the communication control unit does not receive a connection signal through the connection line 34.

Here, a format of a unique command having the above-mentioned DMX512-A standard is used for the used command. As illustrated in FIG. 3(*c*), slot 0 to slot 2 are as illustrated in FIG. 3(*a*). Slot 3 is a command length (the number of bytes), and slot 4 is a command number indicating contents of a command.

After the address mode start command is transmitted, the master control unit 10 outputs a connection signal to the control line 34 after a certain period of time (step S14). Thereby, one light-emitting module 20 in which an address is not set when seen from the communication I/F unit 12 is generated. At first, the light-emitting module 20 which is directly connected to the master control unit 10 through the control line 34 serves as a light-emitting module 20 in which an address is not set.

In addition, the master control unit 10 determines an address (for example, a DMX address) (step S18). The master control unit 10 determines an address by setting values of the address in an ascending order at a predetermined timing after the address mode is started. Then, the master control unit 10 creates an address assigning command including the determined address (step S20). For example, as described above, the address assigning command includes high-order 8 bits (AD-H) of a DMX address in slot 5 and includes low-order 8 bits (AD-L) of a DMX address in slot 6.

The master control unit 10 outputs the created address assigning command to the communication line 32 through the communication I/F unit 12 (step S22). As described above, the communication control unit 22 of each of the plurality of light-emitting modules 20 does not accept an address assigning command that flows through the communication line 32, as long as the communication control unit does not receive a connection signal through the connection line 34. For this reason, the address assigning command flowing through the communication line 32 can be received by only one light-emitting module 20. At this timing, the light-emitting module 20 which is directly connected to the master control unit 10 through the control line 34 accepts the address assigning command that flows through the communication line 32. Meanwhile, the processes of step S18 to step S22 are equivalent to processes that are performed by a transmission unit.

In the light-emitting module 20 having received the address assigning command, the communication I/F unit 23 receives the address assigning command which is transmitted from the communication I/F unit 12. The received command is supplied to the communication control unit 22. When the communication control unit 22 confirms that the supplied command is an address assigning command in accordance with slot 0 to slot 4, the communication control unit extracts an address from slot 5 and slot 6 and sets the extracted address as its own address (step S24). Meanwhile, in the process of setting an address of step S24, the process of extracting an address corresponds to a process performed by an acquisition unit. In addition, the address is stored in, for example, a memory included in the light-emitting module 20.

Then, the communication control unit 22 outputs a connection signal to a control line 34 connected to the communication control unit 22 (step S26), and terminates the address mode (step S28). The next light-emitting module 20 can receive an address assigning command by the output of the connection signal to the control line 34. On the other hand, since the light-emitting module 20 having an address set therein has terminated the address mode, the communication control unit 22 included in the light-emitting module 20 does not accept an address assigning command that flows through the communication line 32. In this manner, only the next light-emitting module 20 can communicate with the master control unit 10 through the communication line 32.

Then, the light-emitting module 20 also sets an address by performing the above-mentioned processes (step S20 to step S28). An address is set in all of the light-emitting modules 20 by repeating such processes.

Meanwhile, even when a portion of the light-emitting module 20 is exchanged and an address is set again, the procedure is the same as the above-mentioned procedure. Specifically, after a portion of the light-emitting module 20 is exchanged, a user performs an input operation for setting an address mode on the operation unit 40. Then, the operation unit 40 generates an address assigning instruction and outputs the generated instruction to the master control unit 10 (step S10). When the master control unit 10 receives the address assigning instruction, the master control unit 10 creates an address mode start command and transmits the created address mode start command to each of the plurality of light-emitting modules 20 through the communication I/F unit 12 and the communication line 32 (step S11). In each of the light-emitting modules 20, when the communication I/F unit 23 receives the address mode start command which is transmitted from the communication I/F unit 12, the communication control unit 22 of each of the light-emitting modules 20 resets address information. Thereafter, processes of step S12 and the subsequent steps are performed.

According to the above method, addresses of the plurality of light-emitting modules 20 are set in a connection order in the control line 34. For this reason, when the plurality of light-emitting modules 20 are connected by the control line 34 as determined in advance, addresses can be set in the plurality of light-emitting modules 20 as desired.

After an address is set in all of the communication control units 22, the master control unit 10 outputs control data (for example, data indicating a light-emitting pattern) for controlling light emission of the light-emitting module 20 to the communication line 32 in association with the address of the target light-emitting module 20. When the control data corresponding to the address of the light-emitting module 20 is output to the communication line 32, the communication control unit 22 causes the light-emitting control unit 24 to receive the control data. The light-emitting control unit 24 controls the light emission of the light source 26 based on the received control data.

Figure 5:
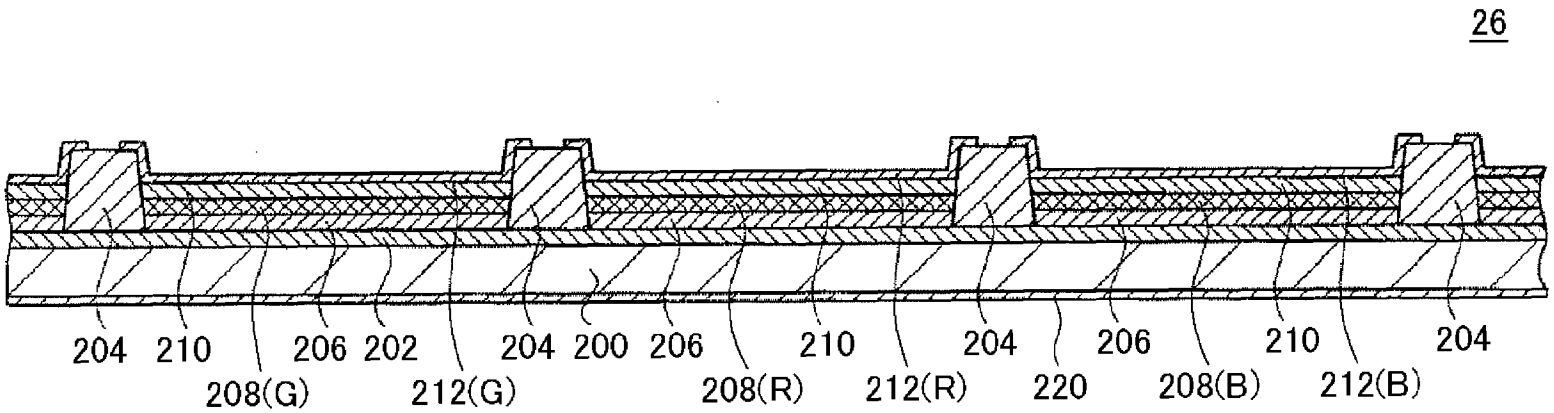
FIG. 5 is a cross-sectional view illustrating an example of the configuration of a light source.

FIG. 5 is a cross-sectional view illustrating an example of the configuration of the light source 26. In the present example, the light source 26 is an organic EL panel, and is configured such that a first electrode 202, a hole injection layer 206, a light-emitting layer 208, an electron injection layer 210, and a second electrode 212 are laminated on a substrate 200 in this order. In addition, a plurality of partition walls 204 are formed on the first electrode 202. The partition wall 204, which is formed of an insulating material, partitions the laminated structure of the hole injection layer 206, the light-emitting layer 208, the electron injection layer 210, and the second electrode 212 into a plurality of regions. In the adjacent regions, at least the light-emitting layers 208 are formed of different materials, and emission spectra thereof have different maximum peak wavelengths.

The substrate 200 is formed of a material (for example, glass or a resin) which transmits light emitted from the light-emitting layer 208. The first electrode 202 is an anode and transmits light emitted from the light-emitting layer 208. The first electrode 202 is made of, for example, ITO, but may be formed of another material. The first electrode 202 is formed by, for example, a sputtering method. In addition, a light extraction layer 220 (for example, a light extraction film) is provided on a surface of the substrate 200 which is opposite to the first electrode 202.

The partition wall 204 has an elongated shape and is formed, for example, by forming an organic insulating layer on the first electrode 202 by a sputtering method or a printing method and by patterning the organic insulating layer. When the organic insulating layer is formed of a photosensitive material, the patterning is performed through exposure and development (photolithography technique). The cross-sectional shape of the partition wall 204 is a trapezoid, and the bottom portion thereof comes into contact with the first electrode 202.

Meanwhile, a plurality of auxiliary electrodes (bus lines) may be formed on the first electrode 202. The auxiliary electrode is formed of a material having a resistance lower than that of the first electrode 202. In this case, the partition wall 204 is formed on the auxiliary electrode.

All of the hole injection layer 206, the light-emitting layer 208, and the electron injection layer 210 are organic layers. The layers are formed using a deposition method or a coating method (for example, an ink jet method). Meanwhile, a hole transport layer may be formed between the hole injection layer 206 and the light-emitting layer 208, and an electron transport layer may be formed between the light-emitting layer 208 and the electron injection layer 210.

The second electrode 212 is formed of a metal such as, for example, Al. The second electrode 212 is formed by forming a conductive layer by a sputtering method and then patterning the conductive layer. The second electrode 212 is divided on the top face of the partition wall 204.

In such a configuration, the light-emitting layer 208 can emit light according to each emission spectrum. For example, in the example illustrated in the drawing, as the light-emitting layer 208, a layer emitting red light (light-emitting layer 208 (R)), a layer emitting green light (light-emitting layer 208 (G)), and a layer emitting blue light (light-emitting layer 208 (B)) are repeatedly provided. The light-emitting control unit 24 determines which light-emitting layer is made to emit light with what degree of strength, based on the control data transmitted from the master control unit 10.

Figure 6:
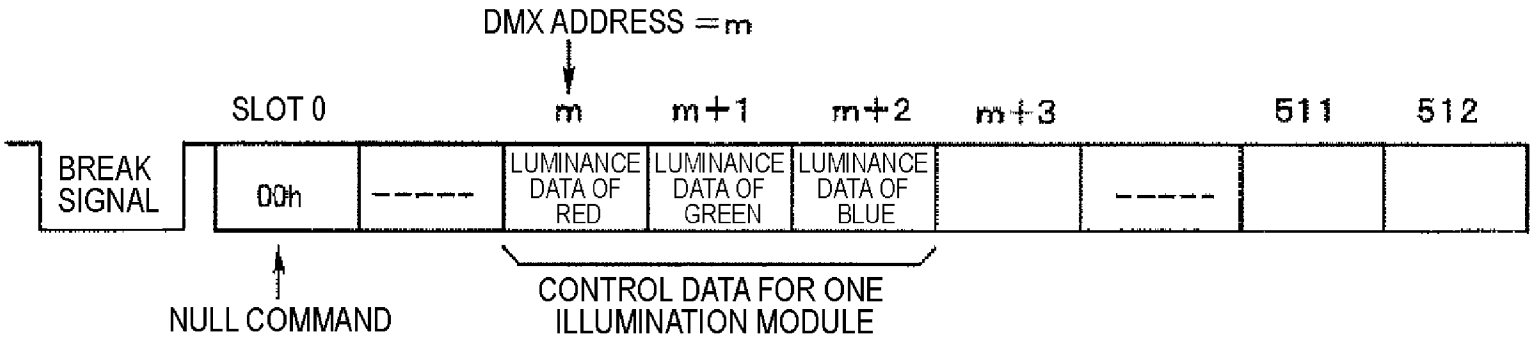
FIG. 6 is a diagram illustrating an example of a format of control data which is transmitted to a light-emitting control unit by the master control unit.

FIG. 6 is a diagram illustrating an example of a format of control data which is transmitted to the light-emitting control unit 24 by the master control unit 10. As described above, when illumination control is performed, a null command (00 h) is used as a start code. In addition, pieces of data indicating emission intensities of the light sources 26 in the respective light-emitting modules 20 are stored in the remaining bytes in order of their addresses. In the example illustrated in the drawing, since the light-emitting module 20 includes three colors (red, green, and blue) of light-emitting layers, a 3-byte signal is used for one light-emitting module 20.

As described above, also in the present example, the same effects as in the embodiment described above can be obtained. In addition, the master control unit 10 updates an address which is output to the communication line 32 when a predetermined period of time elapses. Therefore, also in asynchronous serial communication such as DMX512-A, it is possible to set different addresses in the plurality of light-emitting modules 20.

In addition, the communication control unit 22 does not accept a signal from the communication line 32 before receiving a connection signal. Therefore, it is possible to prevent the same address from being set in the plurality of communication control units 22.

In addition, the communication control unit 22 includes a reception terminal that receives a connection signal and an output terminal that outputs the connection signal. Therefore, it is possible to easily connect the plurality of communication control unit 22 in series using the control line 34.

Meanwhile, in the present example, the activation or inactivation of the communication I/F unit 23 may be controlled instead of the turn-on or turn-off of the communication control unit 22. In addition, when the communication control unit 22 is a part of the functions of a microcomputer, the microcomputer itself may be set to in an active or inactive state. In addition, the power supply of the light-emitting module 20 may be set to be in an active or inactive state.

Example 2

Figure 7:
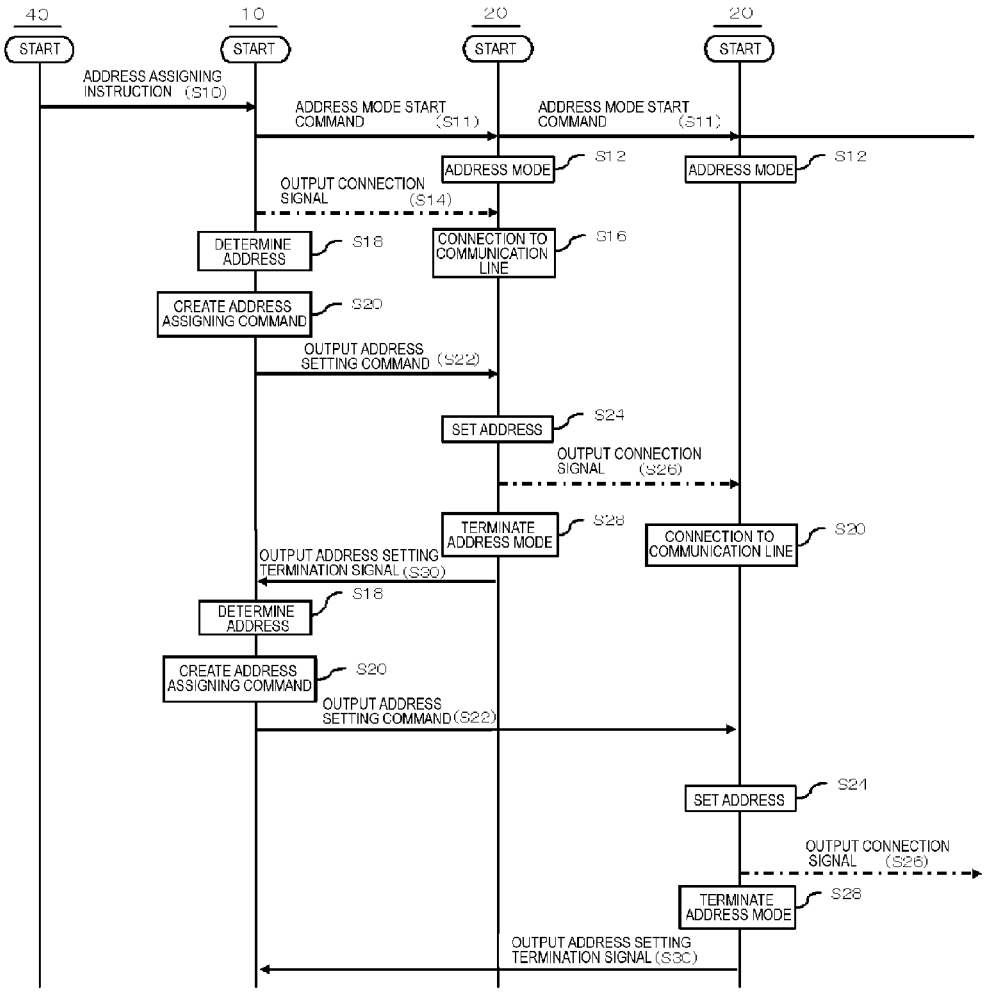
FIG. 7 is a flow chart illustrating the operation of the light-emitting device according to Example 2.

FIG. 7 is a flow chart illustrating the operation of a light-emitting device 100 according to Example 2, and corresponds to FIG. 4 in Example 1. The light-emitting device 100 according to the present example performs the same operation as that of the light-emitting device 100 according to Example 1 except in the following respects.

First, after the setting of an address is terminated (step S24), a light-emitting module 20 outputs an address setting termination signal indicating that the setting of the address has been terminated, to a master control unit 10 through a communication line 32 (step S30). A transmission timing of the address setting termination signal may be later or earlier than the termination of an address mode (step S28). In addition, the master control unit 10 updates an address which is output to the communication line 32 after receiving the address setting termination signal (step S18).

Also in the present example, the same effects as in the embodiment described above can be obtained.

Example 3

A light-emitting device 100 according to Example 3 has the same configuration as that of the light-emitting device 100 according to Example 1 or Example 2 except in the following respects.

First, a master control unit 10 knows the number of light-emitting modules 20 included in the light-emitting device 100. In addition, when the master control unit 10 finishes outputting the same number of addresses as the number of light-emitting modules 20 included in the light-emitting device 100 to the communication line 32, the master control unit terminates a process of setting an address.

Also in the present example, the same effects as in Example 1 or Example 2 can be obtained.

Example 4

A light-emitting device 100 according to Example 4 has the same configuration as that of the light-emitting devices 100 according to Example 1 to Example 3 except for the configuration of the light source 26.

Also in the present example 4, a light source 26 has the same layered structure of a light-emitting layer 208 (illustrated in FIG. 5) in any region. The light-emitting layer 208 may be configured to emit white light by mixing materials for emitting a plurality of colors of light. In addition, the light-emitting layer 208 may have a configuration in which a plurality of light-emitting layers are laminated. In this case, the plurality of light-emitting layers emit different colors of light (for example, red, green, and blue). In addition, when the plurality of light-emitting layers emit light at the same time, the light-emitting device emits white light.

In addition, in control data which is transmitted to a light-emitting control unit 24 by a master control unit 10, it is sufficient to allocate one byte to one light-emitting module 20.

Also in the present example, the same effects as in Example 1 or Example 2 can be obtained.

Although the embodiment and the examples have been described so far with reference to the accompanying drawings, these are merely illustrative of the invention, and various other configurations may be adopted.

The invention claimed is:

1. A light-emitting device comprising:

a plurality of light-emitting modules;

a master control unit that generates control data for the plurality of light-emitting modules; and a communication line through which the control data is output from the master control unit and to which the plurality of light-emitting modules are connected in parallel, wherein each of the plurality of light-emitting modules includes a light-emitting source, a light-emitting control unit that controls the light-emitting source, and a communication control unit that controls connection between the light-emitting control unit and the communication line, and wherein the plurality of communication control units are connected to each other in series through a control line, and the communication control unit located at an uppermost stream is connected to the master control unit, wherein the master control unit outputs an address of the light-emitting module to the communication line, as the control data, and wherein the communication control unit receives a connection signal for controlling connection between the communication line and the corresponding communication control unit through the control line.

2. The light-emitting device according to claim 1, wherein the communication control unit located at an uppermost stream receives the connection signal from the master control unit through the communication line, and wherein the communication control unit sets the address flowing through the communication line as an address thereof on receiving the connection signal through the control line, transmits the connection signal to the communication control unit located subsequent thereto on setting the address, and does not accept the address flowing through the communication line thereafter.

3. The light-emitting device according to claim 2, wherein the master control unit updates the address which is output to the communication line when a predetermined period of time elapses.

4. The light-emitting device according to claim 2, wherein, on setting the address, the communication control unit outputs to the communication line an address setting termination signal indicating a setting of the address, and wherein, on receiving the address setting termination signal through the communication line, the master control unit updates the address which is output to the communication line.

5. The light-emitting device according to claim 1, wherein the communication control unit includes a reception terminal that receives the connection signal and an output terminal that outputs the connection signal.

6. The light-emitting device according to claim 1, wherein the communication control unit does not accept the address flowing through the communication line before receiving the connection signal.

* * * * *